US008167373B2

(12) United States Patent
Allison et al.

(10) Patent No.: US 8,167,373 B2
(45) Date of Patent: May 1, 2012

(54) HEIGHT ADJUSTMENT MECHANISM FOR A CHAIR

(75) Inventors: Gregory Allison, Orefield, PA (US); Arkady Golynsky, Allentown, PA (US)

(73) Assignee: Knoll, Inc., East Greenville, PA (US)

( * ) Notice: Subject to any disclaimer, the term of this patent is extended or adjusted under 35 U.S.C. 154(b) by 285 days.

(21) Appl. No.: 12/478,060

(22) Filed: Jun. 4, 2009

(65) Prior Publication Data

US 2009/0302657 A1 Dec. 10, 2009

Related U.S. Application Data

(60) Provisional application No. 61/059,299, filed on Jun. 6, 2008.

(51) Int. Cl.
*A47C 3/30* (2006.01)

(52) U.S. Cl. ..... 297/344.19; 297/463.1

(58) Field of Classification Search ..... 297/300.3, 297/301.2, 302.2, 303.3, 344.18, 344.19
See application file for complete search history.

(56) References Cited

U.S. PATENT DOCUMENTS

| | | | | |
|---|---|---|---|---|
| 2,605,987 | A * | 8/1952 | Brown et al. | 248/408 |
| 3,327,985 | A * | 6/1967 | Levit et al. | 297/344.18 |
| 3,437,373 | A * | 4/1969 | Boston | 297/344.22 |
| 3,756,654 | A * | 9/1973 | Bauer | 297/344.19 |
| 4,072,288 | A | 2/1978 | Wirges et al. | |
| 4,076,308 | A | 2/1978 | Slabon et al. | |
| 4,354,398 | A * | 10/1982 | Porter | 74/501.6 |
| 4,373,692 | A | 2/1983 | Knoblauch et al. | |
| 4,408,800 | A | 10/1983 | Knapp | |
| 4,555,085 | A * | 11/1985 | Bauer et al. | 248/561 |
| 4,595,237 | A | 6/1986 | Nelsen | |
| 5,035,466 | A | 7/1991 | Mathews et al. | |
| 5,069,496 | A | 12/1991 | Kunh et al. | |
| 5,222,783 | A | 6/1993 | Lai | |
| 5,433,409 | A | 7/1995 | Knopp | |
| 5,577,804 | A | 11/1996 | Tedesco | |
| 5,577,807 | A * | 11/1996 | Hodge et al. | 297/463.1 |

(Continued)

FOREIGN PATENT DOCUMENTS

DE 521850 C 3/1931

(Continued)

OTHER PUBLICATIONS

PCT International Search Report, dated Sep. 11, 2009.

*Primary Examiner* — Peter R. Brown
(74) *Attorney, Agent, or Firm* — Buchanan Ingersoll & Rooney PC

(57) ABSTRACT

A height adjustment mechanism is disclosed that includes a pedestal height variability mechanism. The pedestal height variability mechanism includes a first member and a biasing mechanism. The biasing mechanism is configured to hold the first member in a first position. The first member has a first end and a second end opposite the first end. The biasing mechanism has a first portion attached to the first member adjacent the first end of the first member. The biasing mechanism also has a second portion attached to the first member adjacent to the second end of the first member. Preferably, a second member is also provided that is moveably attached to the first member. The second member may be configured such that movement of the second member actuates height adjustment of a chair.

22 Claims, 6 Drawing Sheets

U.S. PATENT DOCUMENTS

| | | | | |
|---|---|---|---|---|
| 5,671,972 | A | 9/1997 | Tedesco | |
| 5,765,804 | A | 6/1998 | Stumpf et al. | |
| 5,813,449 | A * | 9/1998 | Patmore et al. | 296/37.16 |
| 5,899,530 | A | 5/1999 | Tedesco | |
| 5,904,400 | A * | 5/1999 | Wei | 297/353 |
| 5,979,984 | A | 11/1999 | DeKraker et al. | |
| 6,003,943 | A * | 12/1999 | Schneider | 297/303.3 |
| 6,019,429 | A | 2/2000 | Tedesco | |
| 6,290,296 | B1 | 9/2001 | Beggs | |
| 6,349,992 | B1 | 2/2002 | Knoblock et al. | |
| 6,357,827 | B1 | 3/2002 | Brightbill et al. | |
| 6,361,110 | B2 * | 3/2002 | Roslund et al. | 297/344.19 |
| 6,419,320 | B1 * | 7/2002 | Wang | 297/344.19 |
| 6,588,843 | B1 | 7/2003 | Ebenstein | |
| 6,733,080 | B2 | 5/2004 | Stumpf et al. | |
| 6,869,142 | B2 | 3/2005 | Heidmann et al. | |
| 6,913,315 | B2 | 7/2005 | Ball et al. | |
| 6,955,402 | B2 | 10/2005 | VanDeRiet et al. | |
| 7,784,870 | B2 * | 8/2010 | Machael et al. | 297/300.5 |
| 2004/0135414 | A1 | 7/2004 | Weckner | |

FOREIGN PATENT DOCUMENTS

| | | | |
|---|---|---|---|
| WO | 2006/136842 | A2 | 12/2006 |
| WO | WO 2008/041868 | A2 | 4/2008 |

* cited by examiner

HEIGHT ADJUSTMENT MECHANISM FOR A CHAIR

CROSS-REFERENCE TO RELATED APPLICATION

The present application claims the benefit under 35 U.S.C. §119(e) of U.S. Provisional Patent Application Ser. No. 61/059,299, which was filed on Jun. 6, 2008.

FIELD OF THE INVENTION

The present invention relates to chairs and, more particularly, height adjustment mechanisms for chairs.

BACKGROUND OF THE INVENTION

Many types of chairs, particularly office chairs, include a chair base that has a stand or castor base attached to a column. The column is usually attached to a seat frame, a tilt mechanism, or other chair component. The column is also typically configured for movement between different vertical positions.

Gas springs are often included in such columns. For instance, U.S. Pat. Nos. 5,765,804 and 5,433,409 disclose examples of different gas springs that may be utilized in chairs. The gas springs typically include a valve or other actuator at a top portion of the column. A portion of the gas cylinder is typically configured to extend into or out of another portion of the gas cylinder or a support attached to a portion of the chair base to effect height adjustment for the chair.

A number of different actuation mechanisms have been developed to actuate the height adjustment of gas springs or other columns of chair bases. For example, U.S. Pat. Nos. 5,577,804, 4,595,237, 4,408,800, and 4,072,288 disclose different types of height adjustment mechanisms that include such actuation devices.

Most, if not all, gas cylinders require a customized actuation mechanism to actuate height adjustment of a chair. Often, customization is required due to manufacturing tolerances between a chair component fabricator and a gas cylinder or other column supplier. Customization may also be required due to particular design considerations that must be made for other chair components.

The customization of gas cylinders and gas cylinder height adjustment actuation mechanisms significantly increases the costs of manufacturing a chair. A height adjustment mechanism is needed that does not require use of a particular, customized gas cylinder. Preferably, the height adjustment mechanism is designed for use with multiple different types of gas cylinders to permit a design manufacturer to solicit and receive purchase orders from multiple different suppliers of gas cylinders throughout the manufacturing life of a particular chair model.

SUMMARY OF THE INVENTION

A height adjustment mechanism is provided that is sized and configured for attachment to a chair base. The height adjustment mechanism includes a first member and a biasing mechanism. The first member has a first end and a second end opposite the first end. The biasing mechanism has a first portion attached to the first member adjacent to the first end of the first member. The biasing mechanism also has a second portion attached to the first member adjacent to the second end of the first member. The biasing mechanism can be sized and configured to hold the first member in a first position.

Some embodiments of the height adjustment mechanism also include a second member moveably attached to the first member. The second member is configured such that movement of the second member actuates height adjustment of a chair component. The chair component could include, for example, the chair base or a gas cylinder of a chair pedestal.

Preferably, the first portion of the biasing mechanism engages a first upper portion of the first member and the second portion of the biasing mechanism engages a second upper portion of the first member. The first upper portion of the first member preferably has a groove, channel, slot or other opening sized to receive the first portion of the biasing mechanism and the second upper portion of the first member preferably has a groove, channel, slot or other opening sized to receive the second portion of the biasing mechanism In some embodiments of the height adjustment mechanism, the moveable attachment between the first member and the second member is a rotational attachment. The rotational attachment may be between a middle portion of the second member and at least one portion of the first member. Preferably, the at least one portion of the first member is at least one middle portion of the first member and the rotational attachment also includes a pivot pin extending from a first portion of the first member to a second portion of the first member. The pivot pin also extends through the middle portion of the second member.

Embodiments of the height adjustment mechanism can include an elongated member that is attached to the first end of the second member such that movement of the elongated member from a first position to a second position moves the second member. Preferably, the elongated member has a first end and a second end opposite the first end and the first end of the elongated member is attached to the first end of the second member. The elongated member may be a flexible elongated member. For instance, the elongated member may be a wire, a cord, a cable or a chain.

An actuator may be attached to the second end of the elongated member. At least a portion of the actuator is sized and configured to move from a first position to a second position such that movement of at least a portion of the actuator from the first position to the second position moves the elongated member from its first position to its second position.

In some embodiments of the height adjustment mechanism, the biasing mechanism may include a double torsion spring or two or more interconnected torsion springs. Other embodiments of the pedestal height adjustment mechanism may use other biasing mechanisms such as one or more elastomeric spring mechanisms or other elastomeric biasing devices.

Certain embodiments of the height adjustment mechanism may also include a housing that has a channel sized and configured to receive a pedestal of a chair. The first and second members are positioned adjacent to the channel. The first member can be pivotally or moveably attached to the housing and the second member can be moveably attached to the first member such that the second member is moveable adjacent to the channel. Preferably, an end of the second member is moveable into and out of the channel to engage and disengage a valve or other actuator of a pedestal. For example, the second member may be configured to move into and out of the channel to actuate the valve of a gas spring to adjust the height of the gas spring. It should be appreciated that the biasing mechanism is preferably configured to hold the first and second member in a position adjacent the channel such that the second member is moveable for actuation of a height adjustment actuator, such as a valve, that is included on a pedestal.

A chair is also provided. The chair includes a base that has a column that is moveable form a first position to a second position. The first position of the column is located below the second position of the column. A seat is attached to the base and a height adjustment mechanism is attached to the base. The height adjustment mechanism includes a first member and a biasing mechanism attached to the first member. The biasing mechanism includes a first portion attached adjacent to a first end of the first member and a second portion attached adjacent to a second end of the first member. The biasing mechanism is configured to bias the first member in a first position. Preferably, the biasing mechanism is sized and configured to bias the first member such that the biasing mechanism holds the first member in the first position of the first member. The first position of the first member is adjacent to an upper portion of the column.

It should be appreciated that the first position of the first member can locate a portion of the first member in different positions. For example, the first position of the first member can be located such that the first member engages an upper portion of the column. As another example, the first position may be located such that the first member is sufficiently near the upper portion of the column so that an actuation mechanism configured to interact with the column may interact with the column to actuate height adjustment of the column. Preferably, a portion of such an actuation mechanism, such as, for example, the second member mentioned above, is attached to the first member.

Some embodiments of the chair may include a base that has a housing. The housing may have a channel sized and configured to receive the column. At least a portion of the column extends into the channel. The second member is moveable adjacent to the channel. Preferably, the column includes a gas spring and the channel is tapered. The base may also include a plurality of castors attached to the column.

A chair is also provided that includes a base attached to a pedestal height variability mechanism. The pedestal height variability mechanism includes biasing means attached to lever means. The biasing means is attached to the lever means adjacent to a first end of the lever means and adjacent to a second end of the lever means. The first end of the lever means is opposite the second end of the lever means.

Other details, objects, and advantages of the invention will become apparent as the following description of certain present preferred embodiments thereof and certain present preferred methods of practicing the same proceeds.

BRIEF DESCRIPTION OF THE DRAWINGS

Present preferred embodiments of the height adjustment mechanism and chair including such a height adjustment mechanism, are shown in the accompanying drawings and certain present preferred methods of practicing the same are also illustrated therein, in which.

DETAILED DESCRIPTION OF PRESENT PREFERRED EMBODIMENTS

Figure 1:
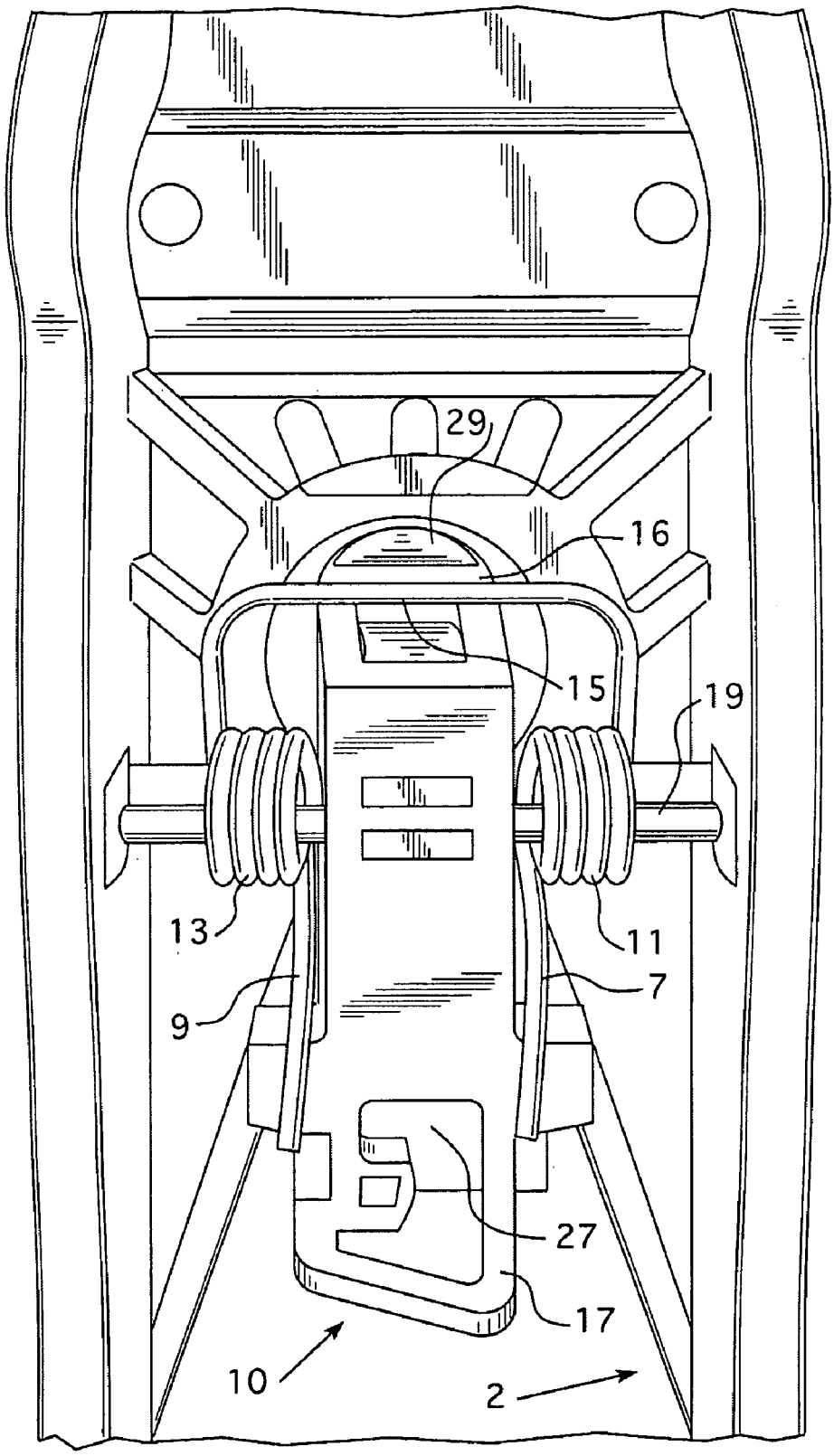
FIG. 1 is a top perspective view of a first present preferred embodiment of the height adjustment mechanism positioned adjacent a seat support structure.
Figure 2:
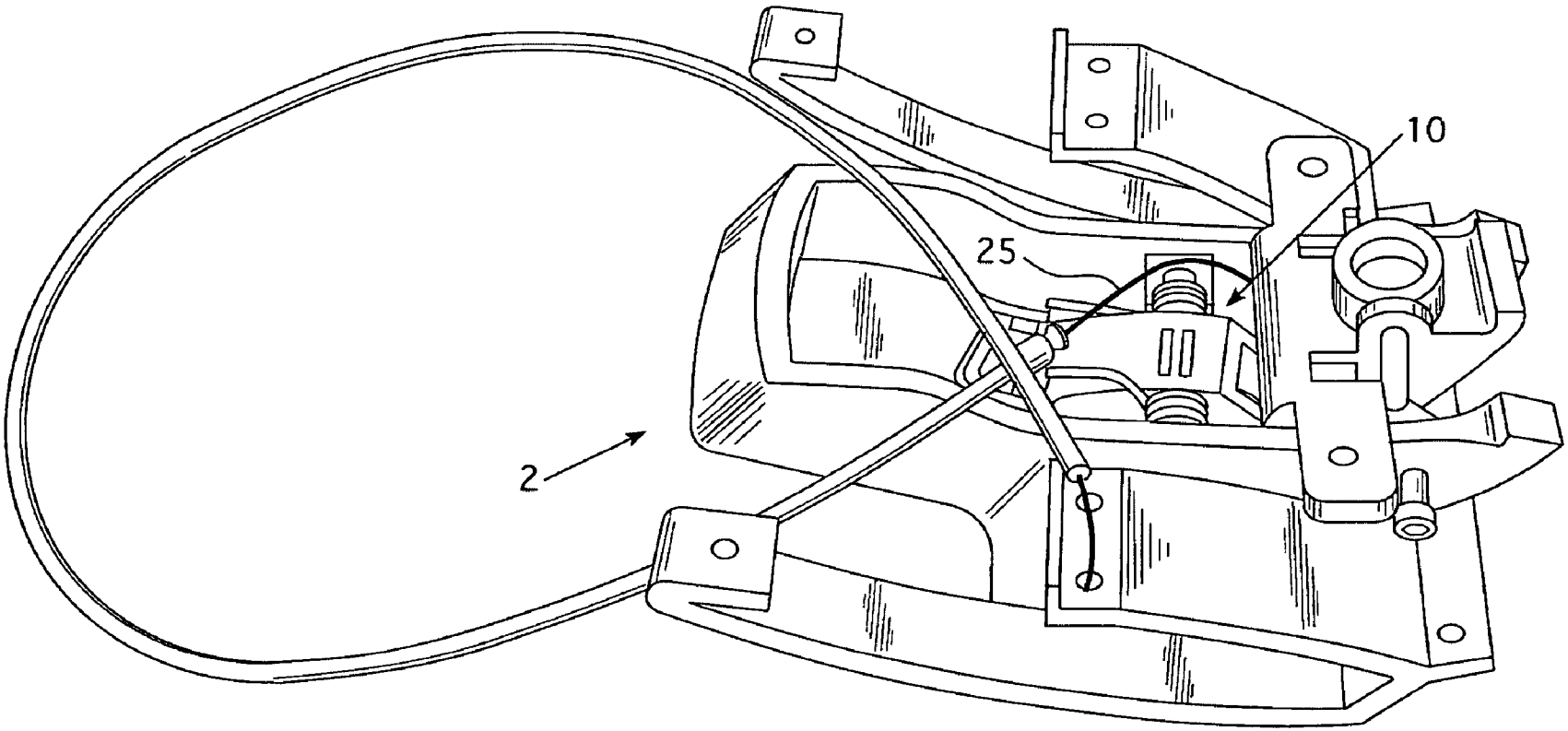
FIG. 2 is a perspective view of the first present preferred embodiment adjacent a seat support structure.

Referring to FIGS. 1-4, a pedestal height variability mechanism is configured to connect a pedestal to a chair component. Preferably, the chair component is a seat, a tilt mechanism or a seat support apparatus and the chair pedestal includes a gas spring or gas cylinder that is engaged by the pedestal height variability mechanism. It should be appreciated that the pedestal height variability mechanism is included in a height adjustment mechanism of a chair.

The pedestal height variability mechanism 10 includes a spring 5 that is attached to a lever 17. Lever 17 may be pivotally attached to a seat support 2 at a pivot point 32. The pivot point 32 may be defined by a portion of the seat support that fits within a recess formed in a portion of the lever such that the lever may move or rotate about the pivot point 32, as may be appreciated from FIGS. 5-7. In alternative embodiments, the lever 17 could include a projection sized to fit within a recess in the seat support 2 for rotation about that recess or could be moveably attached to the seat support 2 using other attachment mechanisms such as, for example, a pivot pin.

Lever 17 is pivotally attached to an actuator 18 at pivot 31, such that the actuator 18 can move relative to the lever 17. The actuator 18 is preferably configured to constantly engage a portion 24 of a pedestal and can be moved to actuate the pedestal to adjust the height of the seat support 2. It should be appreciated that the actuator 18 may be a lever, rod, or other member configured to engage a portion of the pedestal.

The spring 5 has a first end 7 and a second end 9 that engage respective sides of the rear end 27 of the lever 17. The spring 5 has a first coil 11 adjacent the first end 7 and a second coil 13 adjacent the second end 9. The coils 11 and 13 encircle a pin 19 that extends through lever 17. A front middle portion 15 of the spring 5 is positioned adjacent the first and second coils 11 and 13 and is adjacent the front end 29 of the lever 17. A groove 16 is formed in the front end 29 of the lever 17. The groove 16 is sized to receive at least a portion of the front middle portion 15 of the spring 5. The front middle portion 15 and first and second ends 7 and 9 of the spring 5 engage the lever 17 and bias the lever 17 downward to engage a portion of a pedestal that may be inserted through a hole 20 defined in the seat support 2.

Because the front middle portion 15 and the first and second ends 7 and 9 engage opposite ends of the lever 17, substantially more force is transferred from the spring 5 to the lever 17 to bias the lever downward. Such positioning of the ends 7 and 9 and front middle portion 15 of the spring 5 have been found to permit the use of substantially smaller springs than springs that are configured to only act on one end of such levers. For example, it has been determined that some embodiments of this spring configuration permit a 10-20% reduction in the size of the spring 5 necessary to bias the lever 17.

Preferably, the spring 5 is a double torsion spring. In alternative embodiments, the pedestal height variability mechanism 10 can include two torsion springs that are not directly attached to each other. Such springs could be positioned similarly to spring 5. However, instead of an integral front middle portion 15 of the first present preferred embodiment, each spring could have a front end configured to act on the front end 29 of the lever 17. In yet other alternative embodiments, one or more springs or resilient bodies may be positioned adjacent the lever 17 and configured to act on the lever 17 to bias the lever 17 downward, toward hole 20 in the seat support 2.

Figure 3:
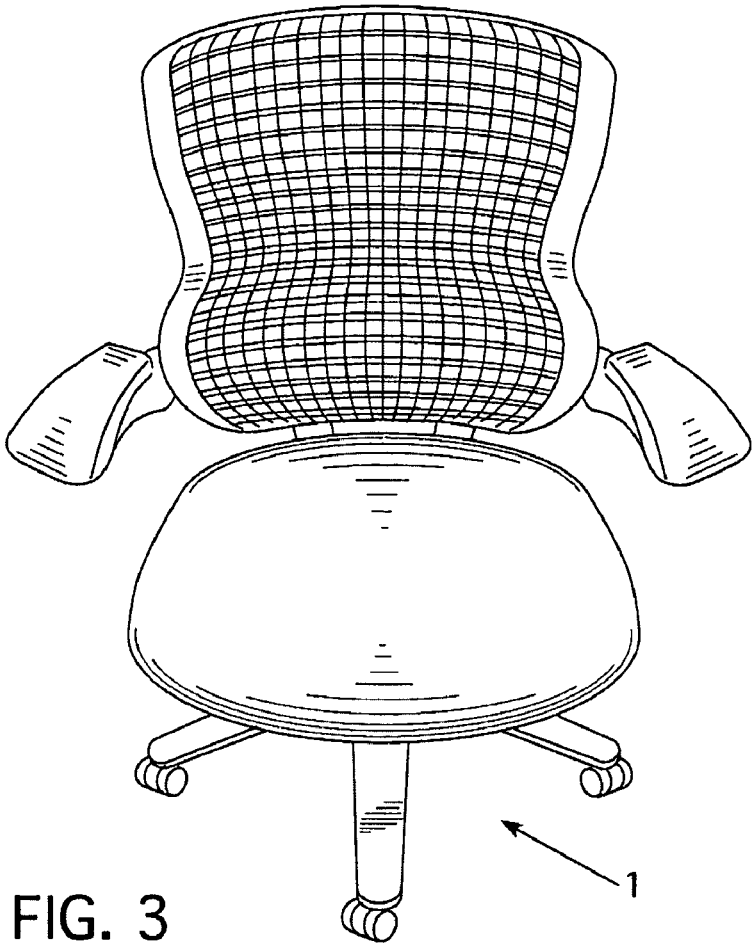
FIG. 3 is a perspective view of a chair that includes the first present preferred embodiment of the height adjustment mechanism attaching the pedestal of the chair to the seat support of the chair.
Figure 4:
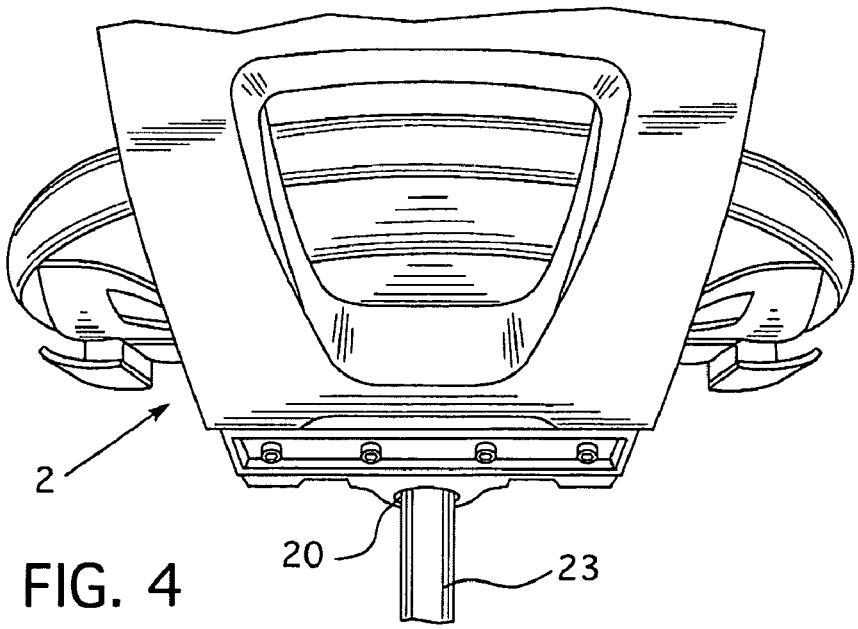
FIG. 4 is a perspective bottom view of a chair that includes the first present preferred embodiment of the height adjustment mechanism attaching the pedestal of the chair to the seat support of the chair.

As may be appreciated from FIGS. 3 and 4, the seat support 2 and pedestal height variability mechanism 10 are configured for attachment to a pedestal 1 or column of a chair base. The pedestal 1 supports a chair and permits the height of the chair to be adjusted. The chair may also include a back and/or a seat that is supported on the seat support 2.

Figure 5:
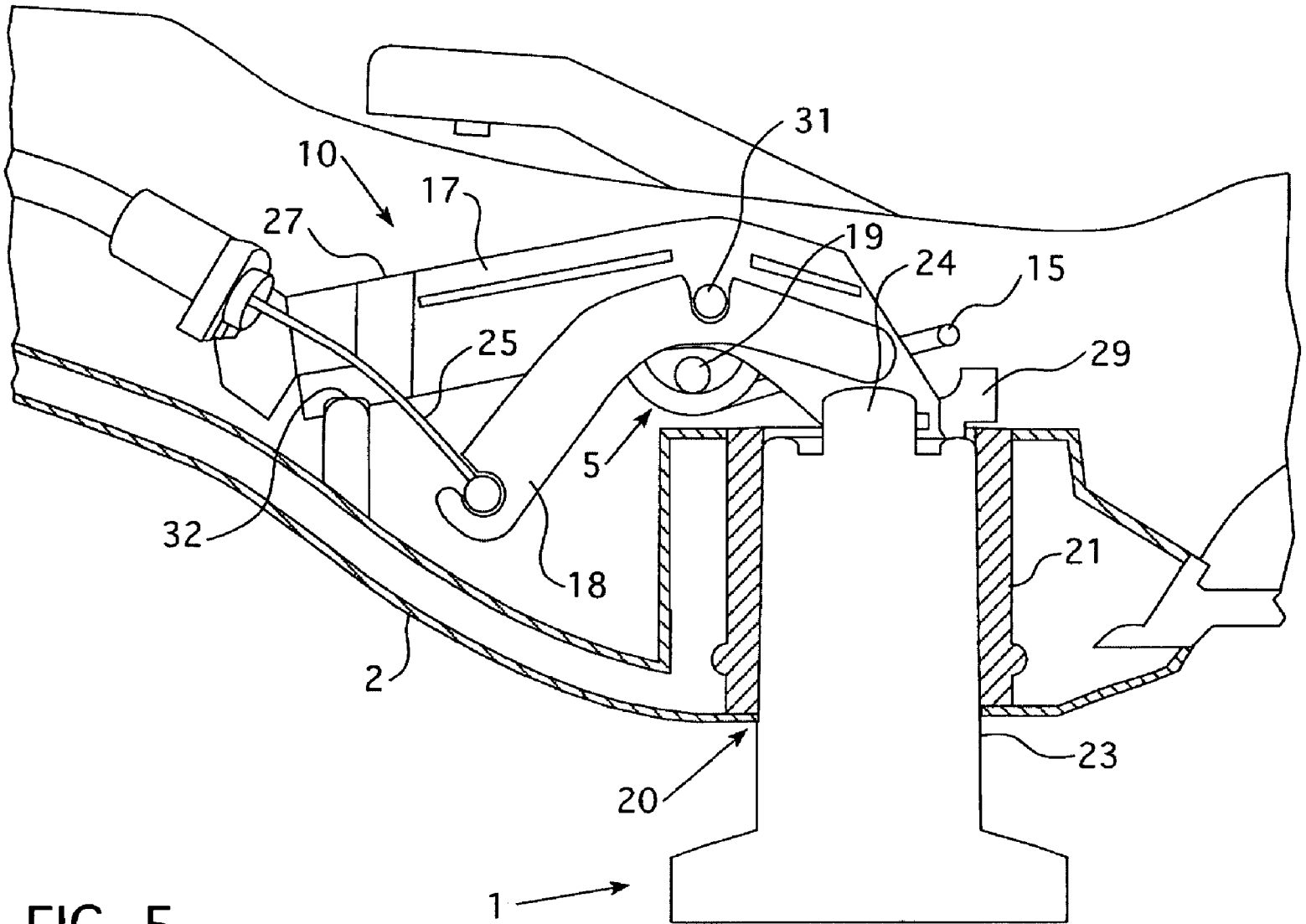
FIG. 5 is a cross sectional view of the first present preferred embodiment engaging a gas spring located in a low position adjacent the bushing.
Figure 6:
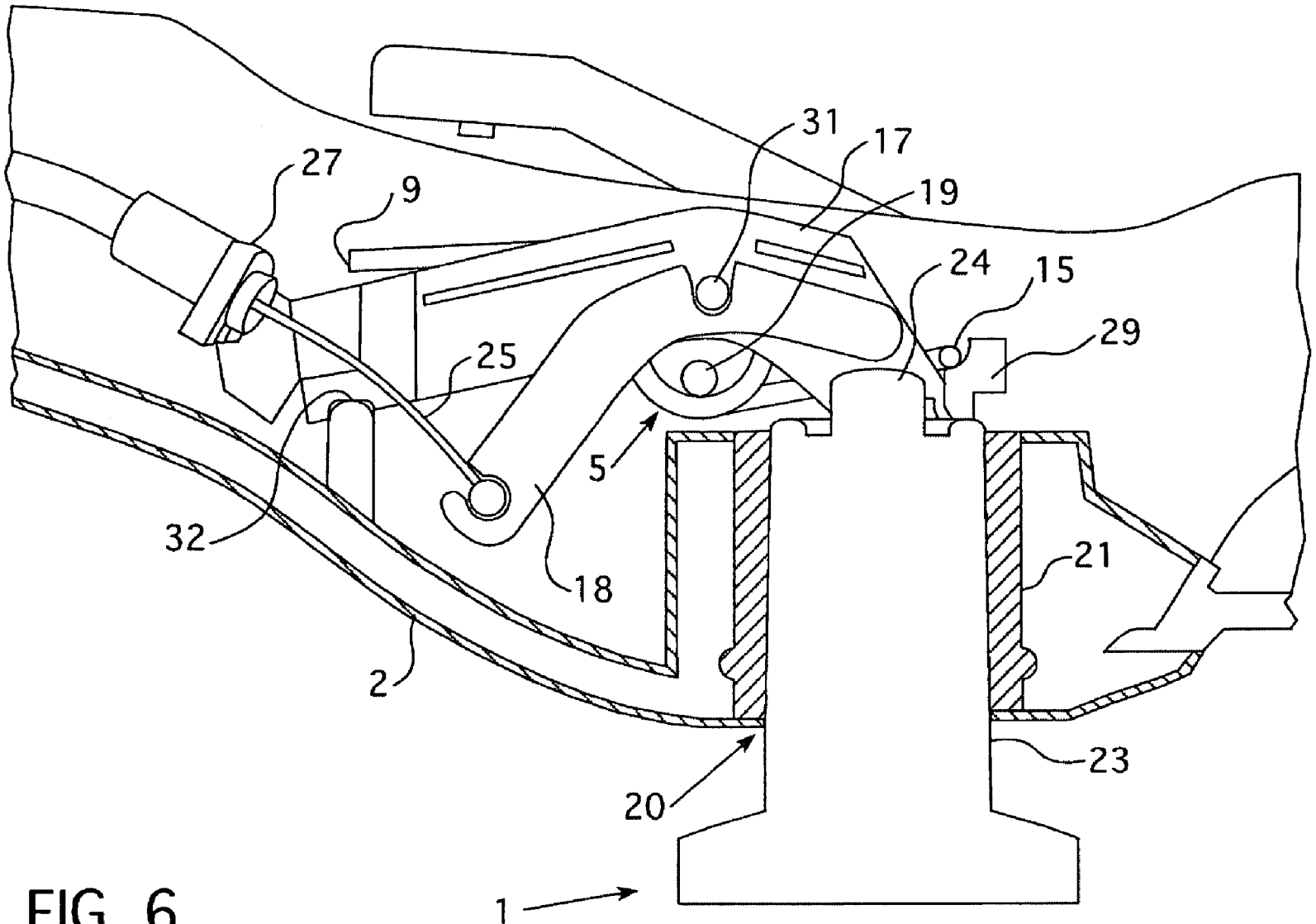
FIG. 6 is a view similar to FIG. 5 of the first present preferred embodiment engaging a gas spring located in a mid-range position adjacent the bushing.
Figure 7:
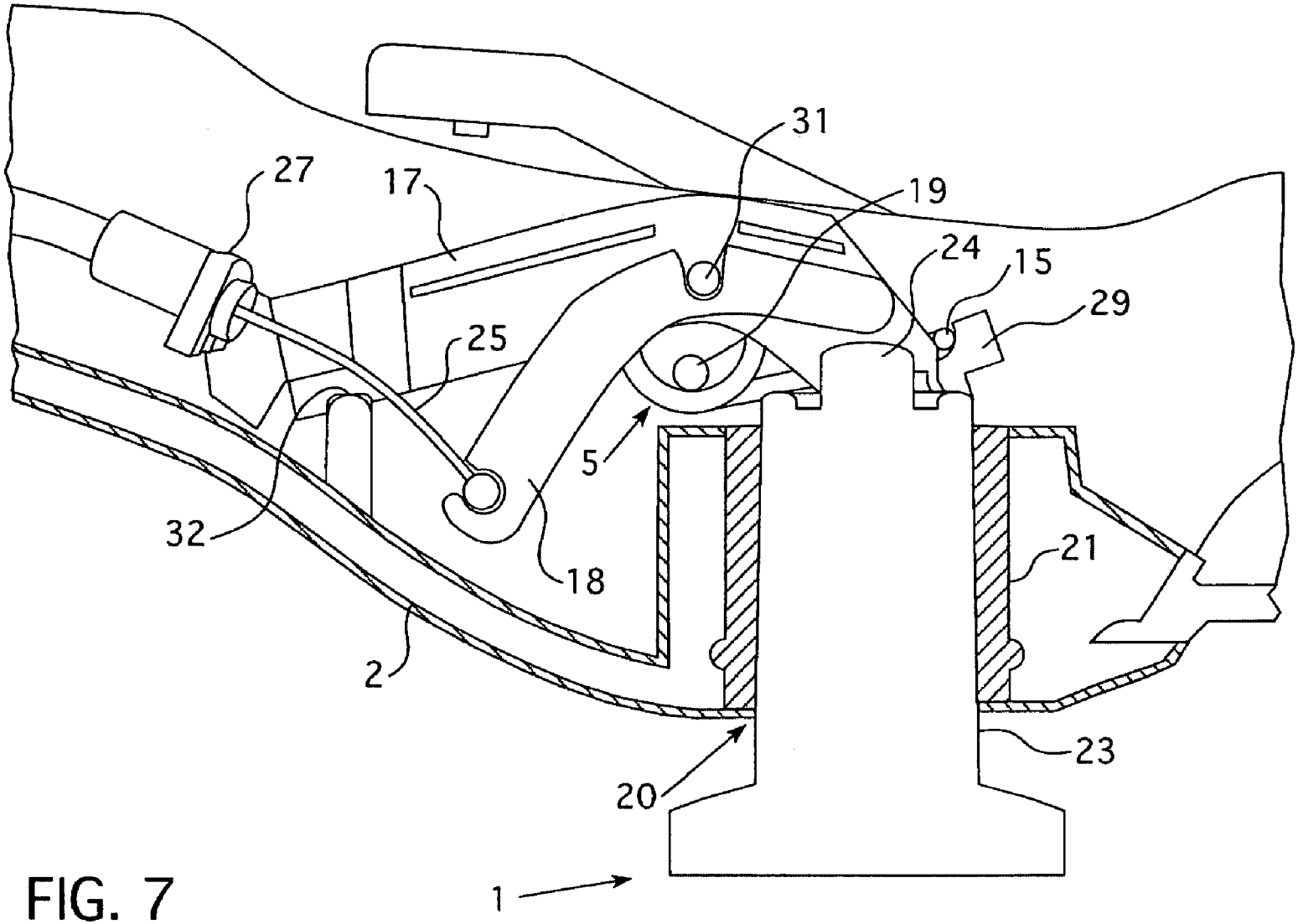
FIG. 7 is a view similar to FIGS. 5 and 6 of the first present preferred embodiment engaging a gas spring located in a high position adjacent the bushing.

As can be seen from FIGS. 5-7, a bushing 21 is inserted into the hole 20 and surrounds a portion of a pedestal inserted into the hole 20. Preferably, the bushing 21 is tapered. The portion of the pedestal may also be tapered. Preferably, the portion of the pedestal inserted into the hole 20 adjacent the bushing 21 is at least a portion of a gas cylinder 23, or gas spring. An actuator (not shown) is attached to an elongated member 25 and is configured to cause the elongated member 25 to move to actuate the gas cylinder 23 of the pedestal. This actuator (not shown) may be positioned adjacent the seat support 2, adjacent an armrest, or at some other location adjacent a component of a chair.

The elongated member 25 is attached to a rotatable actuator 18 that is pivoted to the lever 17. The elongated member 25 may be, for example, a cable, a wire, a flexible elongated member or an elongated member with a particular contour. Movement of the elongated member 25 causes the actuator 18 to engage an actuator 24 of a gas cylinder 23 and move the actuator 24 of the gas cylinder 23 downward to permit height adjustment of the seat support 2. The actuator 24 of the gas cylinder 23 is biased to lock the position of the gas cylinder 23 such that the actuator 24 is biased in an upward position by a biasing force provided by the gas cylinder 23. Consequently, when a force is applied to the elongated member 25 that is not sufficient to overcome the biasing force of the gas cylinder 23, the actuator 24 may move to the upward position to lock the position of the gas cylinder 23 and the height of the pedestal and seat support 2.

It should also be appreciated that the force provided by the spring 5 against the lever 17 to bias the lever 17 downward should be greater than any upward force provided by the actuation of the elongated member 25. Without the spring 5 providing a force to bias the lever downward that is greater than the upward acting force transferred from movement of the elongated member 25 to move the actuator 18, the lever 17 and actuator 18 would be lifted out of engagement with the gas cylinder 23 upon actuation of the actuator 18 and also prevent actuation of the gas cylinder for height adjustment.

Referring to FIG. 5, the gas cylinder 23 is shown in a low position within the hole 20 adjacent bushing 21 such that relatively little force is required from the spring 5 to bias the lever 17 and actuator 18 downward, into engagement with the gas cylinder 23. The front middle portion 15 of the spring 5 and ends 7 and 9 of the spring 5 act on the lever 17 to bias the lever 17 and actuator 18 downward into engagement with the gas cylinder 23. Movement of the elongated member 25 is configured to cause actuator 18 to move to rotate and actuate gas cylinder actuator 24 to adjust the height of the seat support 2. Such actuation can be configured to occur almost instantaneously upon movement of the elongated member 25, which can substantially reduce, if not eliminate, the delay of height adjustment that is typically experienced from other mechanical gas cylinder height adjustment actuation devices.

Referring to FIG. 6, the gas spring 23 is shown in a mid-range position within the hole 20 adjacent the bushing 21 such that significantly more of the gas cylinder 23 is inserted through the hole 20. Such a positioning of the gas cylinder 23 may act against the lever 17 and push the lever 17 upwards from its initial position adjacent the seat support 2. The front middle portion 15 of the spring 5 and ends 7 and 9 of the spring 5 act on the lever 17 to bias the lever 17 and actuator 18 downward into engagement with the gas cylinder 23.

Referring to FIG. 7, the gas spring 23 is shown in a high position, or an extreme upper position, in the hole 20 adjacent the bushing 21. As in the mid-range positioning that is discussed above, this position of the gas cylinder 23 may also act against the lever 17 and push the lever 17 upwards form its initial position adjacent the seat support 2. The front middle portion 15 of the spring 5 and ends 7 and 9 of the spring 5 act on the lever 17 to bias the lever 17 and actuator 18 downward into engagement with the gas cylinder 23.

Because the spring 5 acts on the lever 17, the lever 17 and actuator 18 may receive and operatively connect to various different sized gas cylinders or other pedestal portions. Such functionality permits the seat support 2 to be positioned on various different types of pedestals while still permitting operation of the height adjustment of the structure supported on the pedestal. As a result, various different types of pedestals may be used with the same seat support 2 without requiring any costly modification to the pedestal or the seat support. Moreover, a fabricator may obtain lower prices from gas cylinder suppliers because of the larger range of gas cylinder types and sizes that may be available for connection to the seat support 2.

Many, if not most, office chair designs include pedestals that are customized to permit attachment of a seat support to the pedestal and/or permit actuation of height adjustment of the seat support. It should also be appreciated that embodiments of the pedestal height variability mechanism eliminate the need for customized pedestals and, as a result, also help reduce the cost of fabricating such chairs. Moreover, the manufacturing flexibility can also help a manufacturer obtain new shipments of gas cylinders from different vendors in the event of a supply problem.

Yet another improvement that can be provided by embodiments of the height adjustment mechanism is the fact that only limited movement can be necessary to cause actuation of the height adjustment of the pedestal. For instance, embodiments of the height adjustment mechanism can include an elongated member 25 such as, for example, a wire or cable, that only moves or travels, at most, 7 or 8 millimeters to cause actuator 18 to actuate the actuator 24 of the gas cylinder. Such a configuration can permit the use of wires or cables for use in actuation of the height adjustment of the pedestal without requiring a customized fit of the pedestal to the seat support 2 or other customization of the gas cylinder 23. Of course, other embodiments of the height adjustment mechanism can be configured to permit much longer travel of an elongated member 25 to actuate height adjustment.

It should also be appreciated that embodiments of the height adjustment mechanism can provide significantly quicker height adjustment than other height adjustment mechanisms known to those skilled in the art. For instance, the use of an elongated member 25, such as a cable or wire, can help permit the actuation of the gas cylinder to occur almost instantaneously upon actuation of the elongated member 25.

While certain present preferred embodiments of the pedestal height variability mechanism and certain embodiments of methods of practicing the same have been shown and described, it is to be distinctly understood that the invention is not limited thereto but may be otherwise variously embodied and practiced within the scope of the following claims.

What is claimed is:

1. A height adjustment mechanism sized and configured for attachment to a pedestal of a chair comprising:

a pedestal height variability mechanism comprised of a first member having a first end and a second end opposite the first end and a biasing mechanism having a first portion and a second portion;

the first member being positionable adjacent to a portion of the pedestal;

the first portion of the biasing mechanism attached to or engaging the first member adjacent to the first end of the first member, the second portion of the biasing mechanism attached to or engaging the first member adjacent to the second end of the first member, the biasing mechanism biasing the first member to maintain a position of the first member adjacent to the portion of the pedestal of the chair; and a second member having a first end and a second end opposite the first end, the second member moveably attached to the first member, the second member configured such that movement of the second member actuates height adjustment of the pedestal of the chair.

2. The height adjustment mechanism of claim 1 wherein the first portion of the biasing mechanism engages a first upper portion of the first member and the second portion of the biasing mechanism engages a second upper portion of the first member.

3. The height adjustment mechanism of claim 2 wherein the moveable attachment of the second member to the first member is a rotational attachment, the rotational attachment being between a middle portion of the second member and at least one portion of the first member.

4. A height adjustment mechanism sized and configured for attachment to a pedestal of a chair comprising:

a pedestal height variability mechanism comprised of a first member having a first end and a second end opposite the first end and a biasing mechanism having a first portion and a second portion, the first member being positionable adjacent to a portion of the pedestal;

the first portion of the biasing mechanism attached to or engaging the first member adjacent to the first end of the first member at a first upper portion of the first member, the second portion of the biasing mechanism attached to or engaging the first member adjacent to the second end of the first member at a second upper portion of the first member, the biasing mechanism biasing the first member to maintain a position of the first member adjacent to the portion of the pedestal of the chair;

a second member having a first end and a second end opposite the first end, the second member rotationally attached to the first member between a middle portion of the second member and a middle portion of the first member, the second member configured such that movement of the second member actuates height adjustment of the pedestal of the chair;

wherein the rotational attachment between the first and second members is comprised of a pivot pin extending from adjacent a first side of the first member to adjacent a second side of the first member, the pivot pin also extending through the middle portion of the second member.

5. The height adjustment mechanism of claim 4 further comprising an elongated member having a first end and a second end, the first end of the elongated member attached to the first end of the second member such that movement of the elongated member from a first position to a second position moves the second member.

6. The height adjustment mechanism of claim 5 wherein the elongated member is a flexible elongated member selected from the group consisting of wires, cords, and cables.

7. The height adjustment mechanism of claim 5 further comprising an actuator attached to the second end of the elongated member, at least a portion of the actuator sized and configured to move from a first position to a second position such that movement of the at least a portion of the actuator from the first position to the second position moves the elongated member from the first position of the elongated member to the second position of the elongated member.

8. The height adjustment mechanism of claim 4 wherein the biasing mechanism is comprised of a double torsion spring.

9. The height adjustment mechanism of claim 4 further comprising a housing that has a channel sized and configured to receive the pedestal of the chair, the first and second members being positioned adjacent to the channel, the second member being moveable adjacent to the channel and the biasing mechanism sized and configured to hold the first member in a position adjacent to the channel.

10. A chair comprising:

a base, the base comprising a column, the column being moveable from a first position to at least one second position, the first position of the column being located below the at least one second position of the column;

a seat attached to the base; and a height adjustment mechanism attached to the base of the chair, the height adjustment mechanism comprising a column height variability mechanism comprising:

a first member having a first end and a second end opposite the first end and a biasing mechanism having a first portion and a second portion, the first portion of the biasing mechanism attached to or engaging the first member adjacent the first end of the first member, the second portion of the biasing mechanism attached to or engaging the first member adjacent to the second end of the first member, the biasing mechanism biasing the first member in a position adjacent to an upper portion of the column to maintain the position of the first member adjacent to the upper portion of the column, and a second member having a first end and a second end opposite the first end, the second member moveably attached to the first member, the second member configured such that movement of the second member moves the second member relative to the column to actuate height adjustment of the chair by moving the column from the first position to one of the at least one second position or from one of the at least one second position to the first position.

11. The chair of claim 10 further comprising an elongated member having a first end and a second end, the first end of the elongated member attached to the first end of the second member such that movement of the elongated member from a first position to a second position moves the second member from a first position to a second position.

12. The chair of claim 11 wherein the elongated member is a flexible elongated member selected from the group consisting of wires, cords, and cables.

13. The chair of claim 11 further comprising an actuator attached to the second end of the elongated member, at least a portion of the actuator sized and configured to move from a first position to a second position such that movement of at least a portion of the actuator from the first position to the second position moves the elongated member from the first position of the elongated member to the second position of the elongated member.

14. The chair of claim 10 wherein the base is also comprised of a housing having a channel sized and configured to receive the column, at least a portion of the column extending into the channel, the second member being moveable adjacent to the channel.

15. A chair comprising:

a base, the base comprising a column, the column being moveable from a first position to a second position, the first position of the column being located below the second position of the column, the base also comprised of a housing having a channel sized and configured to receive the column, at least a portion of the column extending into the channel;

a seat attached to the base;

a height adjustment mechanism attached to the base of the chair, the height adjustment mechanism comprising a column height variability mechanism comprising a first member having a first end and a second end opposite the first end and a biasing mechanism having a first portion and a second portion, the first portion of the biasing mechanism attached to or engaging the first member adjacent the first end of the first member, the second portion of the biasing mechanism attached to or engaging the first member adjacent to the second end of the first member, the biasing mechanism biasing the first member in a position adjacent to an upper portion of the column;

a second member having a first end and a second end opposite the first end, the second member moveably attached to the first member, the second member configured such that movement of the second member moves the second member relative to the column to actuate height adjustment of the chair by moving the column from the first position to the second position or from the second position to the first position, the second member being moveable adjacent to the channel, the second member engaging a portion of the column when in a first position of the second member and disengaging that portion of the column when the second member is moved to a second position.

16. The pedestal height adjustment mechanism of claim 15 wherein the biasing mechanism is comprised of a double torsion spring.

17. The chair of claim 15 wherein the channel is tapered and the column is comprised of a gas spring, the second member engaging the column by engaging the gas spring when the second member is in the first position of the second member, the engaging of the gas spring actuating movement of the column.

18. The chair of claim 15 wherein the base is also comprised of a plurality of castors and the column is attached to the castors.

19. The chair of claim 15 wherein the first portion of the biasing mechanism engages the first end of the first member and the second portion of the biasing mechanism engages the second end of the first member.

20. The chair of claim 19 wherein the moveable attachment of the second member to the first member is a rotational attachment, the rotational attachment being between a middle portion of the second member and a middle portion of the first member.

21. A chair comprising:

a base, the base comprising a column, the column being moveable from a first position to a second position, the first position of the column being located below the second position of the column, the base also comprised of a housing having a channel sized and configured to receive the column, at least a portion of the column extending into the channel;

a seat attached to the base;

a height adjustment mechanism attached to the base of the chair, the height adjustment mechanism comprising a column height variability mechanism comprising a first member having a first end and a second end opposite the first end and a biasing mechanism having a first portion and a second portion, the first portion of the biasing mechanism attached to or engaging the first member adjacent the first end of the first member, the second portion of the biasing mechanism attached to or engaging the first member adjacent to the second end of the first member, the biasing mechanism biasing the first member in a position adjacent to an upper portion of the column;

a second member having a first end and a second end opposite the first end, the second member rotationally attached to the first member via a rotational attachment, the rotational attachment being between a middle portion of the second member and a middle portion of the first member, the second member configured such that movement of the second member moves the second member relative to the column to actuate height adjustment of the chair by moving the column from the first position to the second position or from the second position to the first position, the second member being moveable adjacent to the channel; and wherein the rotational attachment is comprised of a pivot pin extending from adjacent a first side of the first member to adjacent a second side of the first member, the pin passing through a middle portion of the second member.

22. The chair of claim 21 wherein the second member is positioned under the first member and the first member is rotatably attached to the housing.

* * * * *